United States Patent [19]

Takano et al.

[11] Patent Number: 4,562,815

[45] Date of Patent: Jan. 7, 1986

[54] FUEL INJECTION PUMP

[75] Inventors: Yoshiya Takano, Katsuta; Yoshikazu Hoshi, Toukai, both of Japan

[73] Assignee: Hitachi, Ltd., Tokyo, Japan

[21] Appl. No.: 577,501

[22] Filed: Feb. 6, 1984

[30] Foreign Application Priority Data

Feb. 4, 1983 [JP] Japan ..... 58-16050
Feb. 18, 1983 [JP] Japan ..... 58-24652

[51] Int. Cl.[4] ..... F02M 59/20

[52] U.S. Cl. ..... 123/450; 123/500; 417/462

[58] Field of Search ..... 123/450, 500, 501, 458, 123/502; 417/462

[56] References Cited

U.S. PATENT DOCUMENTS

| | | | |
|---|---|---|---|
| 4,401,076 | 8/1983 | Sano | 123/450 |
| 4,428,346 | 1/1984 | Hoshi | 123/450 |
| 4,445,822 | 5/1984 | Hoshi | 123/450 |
| 4,450,813 | 5/1984 | Takano | 123/450 |
| 4,458,649 | 7/1984 | Takahashi | 123/450 |

*Primary Examiner*—Carl Stuart Miller
*Attorney, Agent, or Firm*—Antonelli, Terry & Wands

[57] ABSTRACT

A fuel injection pump including an injected amount determining high pressure chamber for determining an injected amount of fuel and an injection timing determining high pressure chamber for determining an injection timing of fuel, with the high pressure chambers being provided independently of each other. A shuttle is disposed in at least the injected amount determining high pressure chamber to form an injection fuel chamber and a pressurization chamber. The injection timing determining high pressure chamber is disconnected from the pressurization chamber in the supply process of fuel for determining the injected amount and fuel for determining the injection timing, and the injection timing determining high pressure chamber is communicated with the pressurization chamber in the fuel injection process. The shuttle for determining the injection timing is not influenced by the fuel for determining the injected amount at the time when the fuel for determining the injected amount is supplied.

7 Claims, 10 Drawing Figures

FUEL INJECTION PUMP

BACKGROUND OF THE INVENTION

The present invention relates to a mechanical fuel injection pump for injecting fuel to internal combustion engines. In, for example, Japanese Laid Open Patent Application No. 57-56660, a mechanical fuel injection pump has been proposed for determining an injected amount of fuel and an injection timing of the fuel, wherein fuel is filled on both sides of a shuttle disposed intermediately in a high pressure chamber, with the fuel on one side of the shuttle being pressurized at a predetermined time to determine the injection timing, and, at the same time, the fuel on the other side of the shuttle being pressurized to determine an injected amount of fuel.

A disadvantage of a fuel injection pump of the aforementioned type resides in the fact that, since fuel for determining the injection timing and fuel for determining the injected amount are respectively supplied to either one side of the shuttle, the fuel for determining the injected amount influences a position of the shuttle thereby resulting in a disturbing or an adverse affecting of the injection timing of the fuel.

SUMMARY OF THE INVENTION

The aim underlying the present invention essentially resides in providing a fuel injection pump which is adapted to independently control an injected amount and an injection timing of fuel, and in which fuel for determining the injected amount of fuel will not influence the injection timing of the fuel.

In accordance with advantageous features of the present invention, an injected amount determining high pressure chamber for determining the injected amount of fuel and an injection timing determining high pressure chamber for determining the injection timing of fuel are provided independently of each other, with a shuttle being disposed in at least the injected amount determining high pressure chamber to form an injection fuel chamber and a pressurization chamber. The injection timing determining high pressure chamber is disconnected from the pressurization chamber in the supply process of fuel for determining the injected amount and fuel for determining the injection timing, and the injection timing determining high pressure chamber is communicated with the pressurization chamber in the fuel injection process, whereby the shuttle for determining the injection timing will not be influenced by the fuel for determining the injected amount at the time when the fuel for determining the injected amount is supplied.

Advantageously, in accordance with the present invention, a fuel injection pump is provided which includes a rotor shaft rotated within a sleeve and a predetermined timed relationship with respect to a rotation of the internal combustion engine, with a first high pressure chamber being axially formed inside the rotor shaft, which high pressure chamber determines an injected amount of fuel. A second high pressure chamber is provided for determining an injection timing of the fuel, with the second high pressure chamber being fluid-tightly isolated from the first high pressure chamber. A shuttle is disposed in the first high pressure chamber to form an injection fuel chamber and a pressurization chamber, with the shuttle being freely movable in the first high pressure chamber. A plunger is provided for pressuizing fuel in the second high pressure chamber in a predetermined time relationship with respect to a rotation of the internal combustion engine. A first fuel supply passage is formed in the sleeve for supplying injection fuel to the injection fuel chamber, with a discharge passage being formed in the sleeve for discharging fuel into the pressurization chamber when fuel is supplied to the injection fuel chamber. A second fuel supply passage is formed in the sleeve for supplying fuel for determining the injection timing to the second high pressure chamber when fuel is supplied to the injection fuel chamber. A connection passage is formed in the sleeve for communicating the pressurization chamber with the second high pressure chamber when fuel in the second high pressure chamber is pressurized by the pressurizing plunger, and a fuel outlet passage is formed in the sleeve for introducing fuel into the injection fuel chamber to a fuel injection valve when fuel in the second high pressure chamber is pressurized.

In accordance with further features of the present invention, electromechanically operated flow rate control valves are disposed in intermediate portions of the first and second fuel supply passages, and a second discharge passage may be formed in the sleeve for discharging fuel in the pressurization chamber when the shuttle is moved by a predetermined distance in such a direction so as to supply fuel in the injection fuel chamber toward the fuel injection valve.

It is also possible in accordance with the present invention to provide a fuel injection pump which includes first and second high pressure chambers axially formed inside the rotor shaft, with third and fourth high pressure chambers being fluid tightly isolated from the second high pressure chamber. A first shuttle is disposed between the first and second high pressure chambers so as to be freely movable between the first and second high pressure chambers, with a second shuttle being disposed between the third and fourth high pressure chambers so as to be freely movable between the third and fourth high pressure chambers. A pressurizing plunger is provided for pressurizing fuel in the fourth high pressure chamber in a predetermined timed relationship with respect to a rotation of the internal combustion engine. A first fuel supply passage is formed in the sleeve for supplying an injection fuel to the first high pressure chamber, with a discharge passage being formed in the sleeve for discharging fuel in the second high pressure chamber when fuel is supplied to the first high pressure chamber. A second fuel passage is formed in the sleeve for supplying a fuel for determining an injection timing to the third high pressure chamber when fuel is supplied to the first high pressure chamber, and a connection passage, formed in the sleeve, communicates the third high pressure chamber with the second high pressure chamber when fuel in the fourth high pressure chamber is pressurized by the pressurizing plunger. A fuel outlet passage is also formed in the sleeve for introducing fuel into the first high pressure chamber to a fuel injection valve when fuel in the fourth high pressure chamber is pressurized.

Advantageously, a stopper arrangement is formed in the fourth high pressure chamber for restricting a movement of the second shuttle such that the second shuttle moves by a predetermined distance when fuel is supplied to the third high pressure chamber.

Furthermore, in accordance with still further features of the present invention, a third fuel supply passage is communicated with the fourth high pressure chamber so that fuel for determining an injection timing different from fuel supplied to the third high pressure chamber may be supplied to the fourth high pressure chamber.

The third fuel supply passage may, in accordance with the present invention, include electromagnetic measuring valves which are adapted to be driven by a control signal from a control unit.

Accordingly, it is an object of the present invention to provide a fuel pump for an internal combustion engine which avoids, by simple means, shortcomings and disadvantages encountered in the prior art.

Another object of the present invention resides in providing a fuel pump wherein the injected amount of fuel and the injection timing of the fuel can be controlled independently of each other.

Yet another object of the present invention resides in providing a fuel pump for an internal combustion engine by which it is possible to eliminate an influence of the fuel for determining the injected amount upon the injection timing thereby ensuring an accurate injection timing.

A still further object of the present invention resides in providing a fuel pump for an internal combustion engine which is simple in construction and therefore relatively inexpensive to manufacture.

Another object of the present invention resides in providing a fuel pump for an internal combustion engine which functions realiably under all operating and load conditions of the internal combustion engine.

These and other objects, features, and advantages of the present invention will become more apparent from the following description when taken in connection with the accompanying drawings, which show, for the purposes of illustration only, several embodiments in accordance with the present invention.

DETAILED DESCRIPTION

Figure 1:
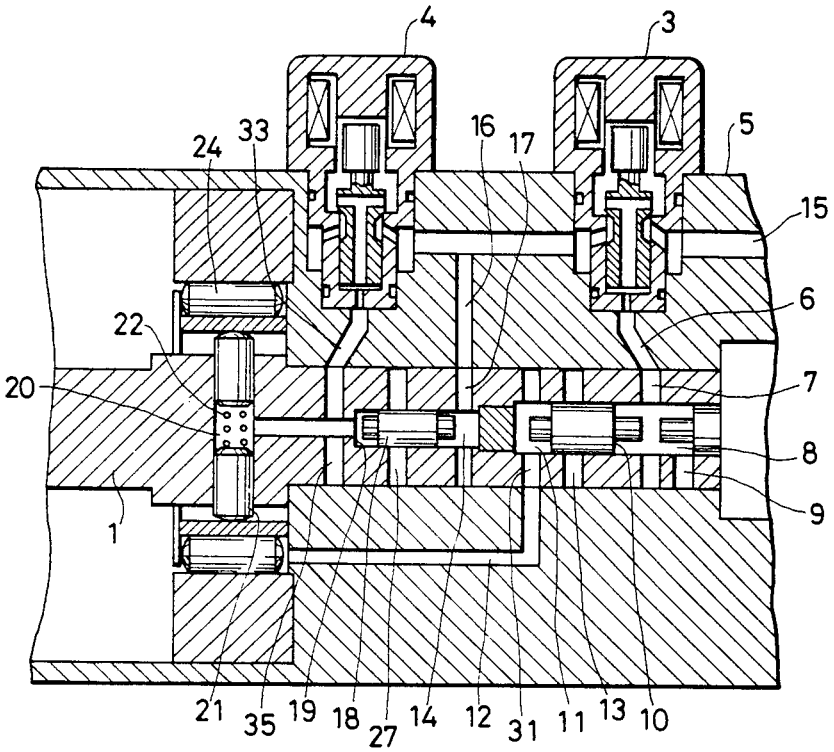
FIG. 1 is a cross sectional view of a portion of a fuel pump constructed in accordance with the present invention.

Referring now to the drawings wherein like reference numerals are used throughout the various views to designate like parts and, more particularly, to FIG. 1, according to this figure, a fuel injection pump includes a rotor 1, driven by an internal combustion engine (not shown) in a predetermined timed relationship therewith through a shaft (not shown) and a coupling (not shown), with a solenoid valve 3 being provided for measuring an injected amount of fuel and a solenoid valve 4 being provided for measuring a fuel amount adapted to control the injection timing. Both solenoid valves 3, 4 are driven, in a conventional manner, in accordance with signals received from a control unit (not shown).

To hole or maintain the injection timing of fuel constant, the fuel amount equivalent to the injected amount of fuel is determined by measuring the fuel sent from a fuel source (not shown) in accordance with an opening time of the solenoid valve 3. The measured fuel is supplied to a first high pressure chamber or injection fuel chamber 8 for determining the injected amount through a fixed supply port 6 formed in a sleeve 5 and one of a plurality of rotary supply ports formed in the rotary shaft 1, with the number of supply ports 7 corresponding to the number of cylinders of the internal combustion engine. At this time, a high pressure port 9 remains closed. With the fuel in amount equivalent to the injected amount being supplied to the first high pressure chamber 8, a first shuttle 10 is moved to the left in FIG. 1 and fuel concerned with or related to the injected amount and contained in a second high pressure chamber or pressurization chamber 11 for determining the injected amount, is discharged to the lower pressure side through a discharge passage 12, so that the fuel, in an amount equivalent to the injected amount, is easily supplied to the first high pressure chamber 8.

During the above noted fuel supply process, it is noted that, first, both the first high pressure chamber 8, supplied with fuel in an amount equivalent to the injected amount, and the second high pressure chamber 11, concerned with or related to discharge, these chambers 8, 11 being communicated with each other during a compression process, have no interference and communication with the fuel amount relating to the injection timing. Second, the left end face of the shuttle 10 is positioned to disconnect the second high pressure chamber 11 from a first spill 13 formed in the rotor shaft 1.

In parallel with the above operation, fuel concerned with or relating to the injection timing is also supplied. More particularly, the fuel is fed or supplied from a supply passage 15 to a third high pressure chamber 14 for determining the injection timing, through a fixed supply port 16 and one of a plurality of rotary supply ports 17, with the rotary supply ports 17 being the same in number as the number of cylinders of the internal combustion engine. During this supply process, the amount of fuel supplied to the third high pressure chamber 14 is restricted by virtue of the face that a second shuttle 18 is moved to the left and a left end face of the second shuttle 18 abuts against a stopper face 19 of the rotor 1. Moreover, a spring 22, adapted to normally expand a plunger in an outward direction, is disposed within a fourth high pressure chamber 20 for determining the injection timing.

The fourth high pressure chamber for determining the injection timing operates in the following manner:

First, since the plunger 21 is normally expanded outwardly by the spring 22 in the fourth high pressure pump chamber 20, a forced attraction force is exerted on the third high pressure chamber 14 through the fourth high pressure pump chamber 20 and the second shuttle 18. Therefore, the second shuttle is surely restricted by the stopper face 19 of the rotor shaft 1 so that the amount of fuel supplied to the third high pressure chamber 14 is always held or maintained constant.

On the other hand, when a certain amount of fuel is supplied to the third high pressure chamber 14, the second shuttle 18 is pushed to the left and the fuel in the fourth high pressure chamber 20 receives a pressure. Thus, the plunger 21, a roller shoe 23, and a roller 24 are expanded outwardly. Regardless of any change in the injected amount, the foregoing operation remains unchanged and the expanded position of the roller 24 is held constant as shown most clearly in solid lines in FIG. 4. The expanded position of the roller 24 is determined by the amounts of fuel respectively supplied to the third and fourth high pressure chambers 14, 20, and that the expanded position of the roller 24 remains unchanged if the amount of fuel supplied to the third high pressure chamber 14 is held constant and no fuel is supplied to the fourth high pressure chamber 20. In otherwords, as will be explained in more detail in connection with the compression process of the fuel pump, a contact position of the roller 24 with a cam 26 always occurs at a point A and, consequently, the injection timing can be maintained constant or held unchanged. In the above described supply process, it is to be noted that the left end face of the second shuttle 18 is positioned so as to disconnect the fourth high pressure chamber 20 from a second spill 27.

Figure 2:
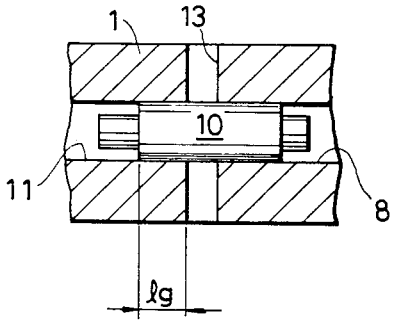
FIGS. 2 and 3 are cross-sectional views, on an enlarged scale, illustrating an operation of a shuttle of the fuel pump of FIG. 1.
Figure 3:
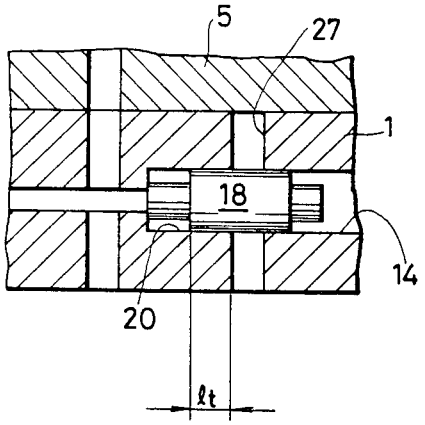

With the fuel supplied to the respective high pressure chambers completed by the foregoing operations, the shuttles 10, 18 and spills assume the positions shown most clearly in FIGS. 2 and 3. More particularly, FIG. 2 illustrates the state for the first and second high pressure chambers 8, 11, whereas, FIG. 3 illustrates the state of the third and fourth high pressure chambers 14, 20. In FIG. 2, $l_q$ represents the amount of fuel equivalent to the injected amount supplied to the first high pressure chamber 8 from the solenoid valve 3. As the amount of fuel supplied to the first high pressure chamber 8 is increased, $l_q$ also increases. In FIG. 3, $l_t$ is always held constant as explained hereinabove and, for this purpose, in order to ensure the constant value of $l_t$, the spring 22 exerts a forced attraction force so as to achieve an easy and positive supply.

The operation for compression and injection of fuel in the fuel pump of the present invention will be described more fully in connection with FIGS. 4–8 which illustrate the relative state of the components of the fuel pump during a compression and injection of the fuel. More particularly, a continued rotation of the rotor shaft 1 causes the ports formed in the rotor shaft 1 and the sleeve 5 to assume the positions illustrated in FIG. 5. More specifically, the high pressure port 9 of the rotor shaft 1 is communicated with an outlet port 28 of the sleeve 5, the first spill 13 with a discharge passage 29, the second spill 27 with a discharge passage 30, and a rotary connection passage 31, opened to the second high pressure chamber 11, is communicated with the rotary supply port 17, opened to the third high pressure chamber 14, through a connection passage 32 formed in the sleeve 5.

Figure 4:
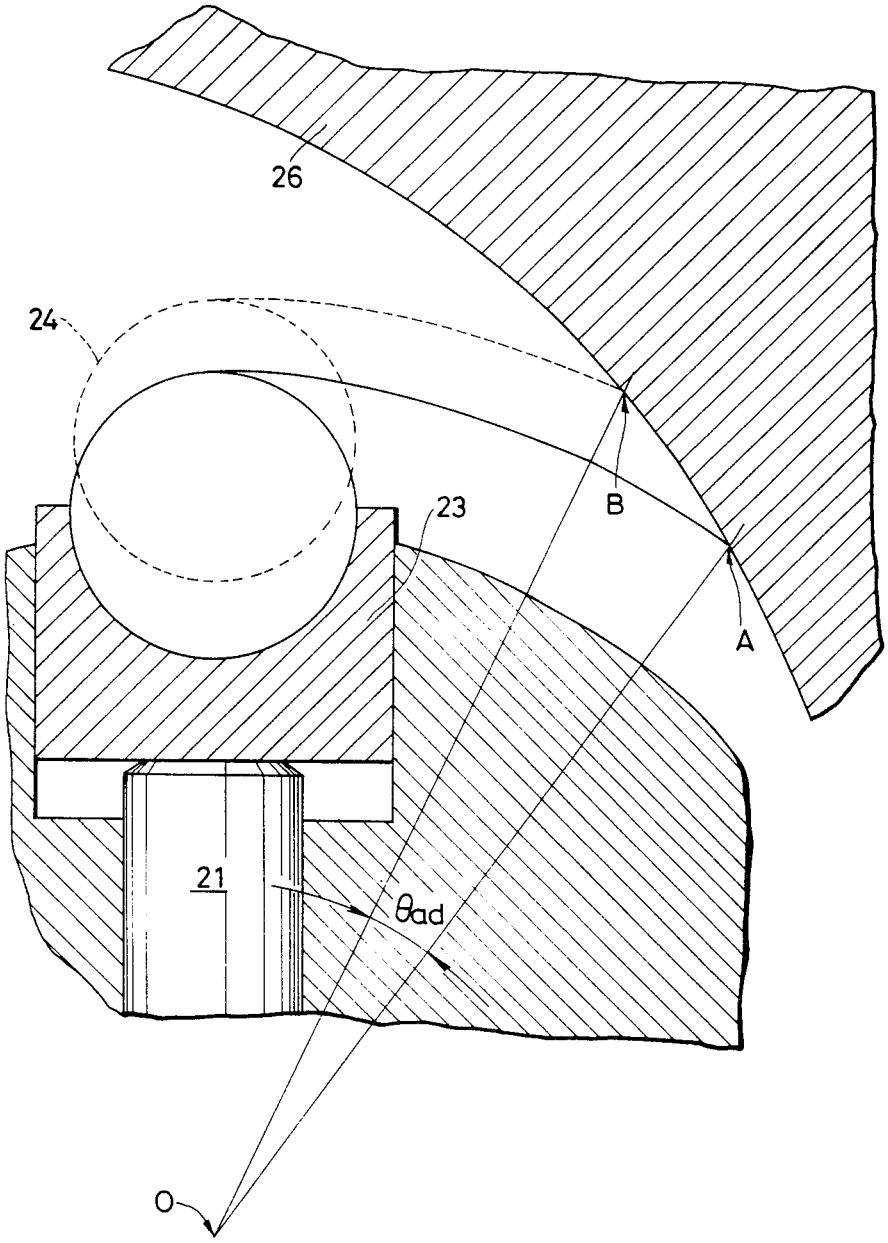
FIG. 4 is a cross-sectional view, on an enlarged scale, of a pump mechanism constructed in accordance with the present invention for enabling a determination of a fuel injection timing.
Figure 5:
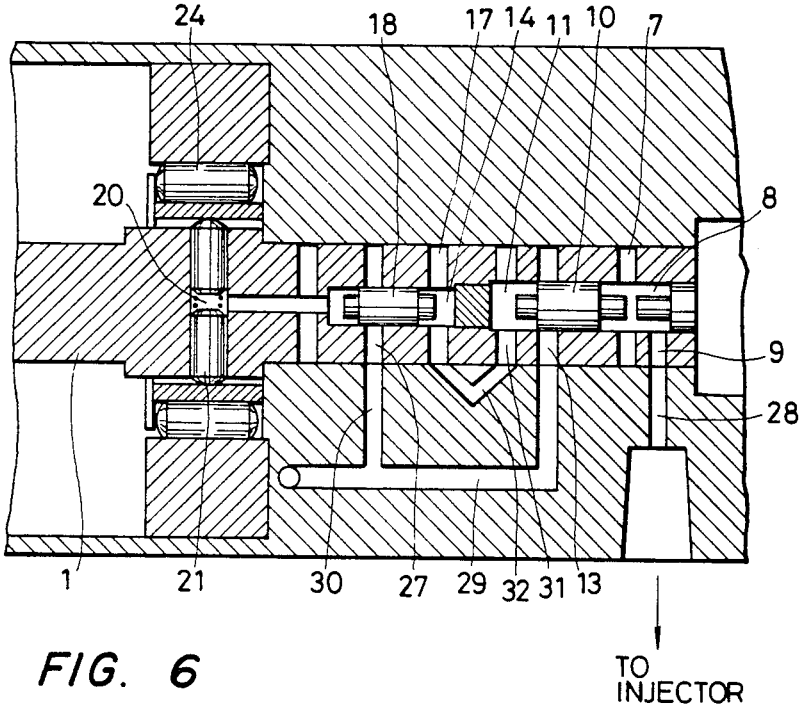
FIG. 5 is a cross-sectional view of another portion of the fuel pump of FIG. 1.

Additionally, to form the foregoing communicated ports, as shown in FIG. 4, an outer periphery of the roller 24, which has been expanded to a predetermined position during a supply of the fuel, starts to contact with the cam 26 at the point A. The roller 24, a roller shoe 23 and the plunger 21 are this pushed inwardly to pressurize the fuel in the fourth high pressure chamber 20 to thereby generate a high pressure which causes the second shuttle 18 to be moved to the right so that the second high pressure chamber 11 is pressurized through the third high pressure chamber 14, rotary supply port 17, connection passage 32, and the rotary connection passage 31 opened to the second high pressure chamber 11. Further, the first shuttle 10 is also moved to the right to pressurize the fuel in the first pump chamber 8, so that the pressurized fuel is injected to a combustion chamber in the internal combustion engine through the high pressure port 9 and the outlet port 28 and then through a delivery valve, high pressure tube, and injection valve (not shown).

As the fuel injection further progresses, the first and second shuttles 10, 18 both continue to move to the right until the left end face of the first shuttle 10 is positioned so as to enable a communication between the second high pressure chamber 11 with the first spill 13 of the rotor shaft 1. This lowers the pressure in a series of pressuirzing passages so that the fuel injection from the first high pressure chamber 8 is completed. This process will be described in greater detail in connection with FIGS. 6 and 7.

Figure 6:
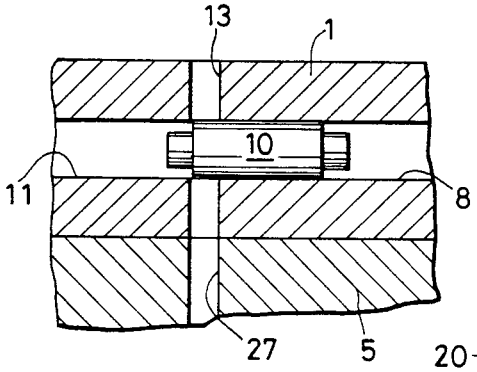
FIGS. 6, 7 and 8 are cross-sectional views illustrating an operation of the shuttle in the fuel pump of FIG. 1.
Figure 7:
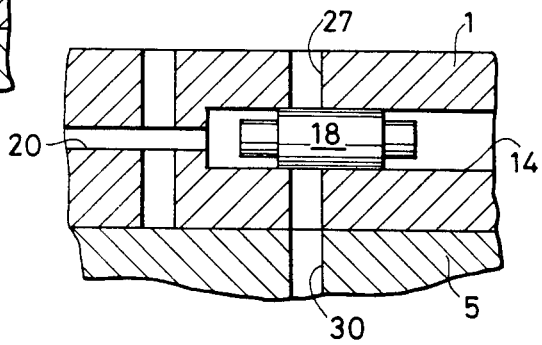
Figure 8:
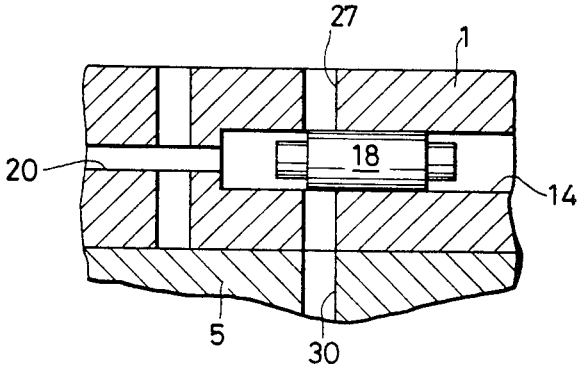

More particularly, FIG. 6 shows a relationship between the first high pressure chamber 8, the second high pressure chamber 11, and the first shuttle 10, while FIG. 7 shows a relationship between the third high pressure chamber 14, the fourth high pressure chamber 20, and the second shuttle 18. As the fuel injection from the first high pressure chamber 8 progresses, the left end face of the first shuttle 10 is positioned so as to enable a communication between the first spill 13 with the second high pressure chamber 11, whereupon the fuel is discharged to the lower pressure side through the discharge passage 29 of the sleeve 5 and, at the same time, the injection of fuel is completed. On the other hand, since the fourth high pressure chamber 20 is not yet in communication with the second spill 27 at this time, the fuel in the third high pressure chamber 14 is still pressurized to continue discharge of fuel from the second high pressure chamber 11 until the roller 24 is removed from the cam 26.

In this manner, the beginning of the above operation, that is, the contact position of the roller 24 with the cam 26, represents the ignition timing. Since, as noted above, the expanded position of the roller 24 is always held stationary during a supply mode of fuel, the second shuttle 18 for determining the injection timing will not be influenced in its movement by the fuel to be injected and, as a result thereof, the injection timing remains unchanged.

In a situation wherein the injection timing is to be advanced, an appropriate amount of fuel may be supplied from the solenoid valve 4 to the fourth high pressure chamber 20 through a fixed supply port 33 formed in the sleeve 5 and a rotary supply port 35 in the rotor 1. This permits the expanded position of the roller 24 to be increased to the position indicated in phantom lines in FIG. 4 and, upon such further expansion, a contact point B of the roller 24 with the cam 23 is advanced by an angle $\phi_{ad}$ as compared with the point A.

Because fuel for advancing the injection timing has been supplied to the fourth high pressure chamber 20, the fuel is discharged therefrom through the second spill 27 and the discharge passage 30. In the above case after a completion of the fuel injection from the first high pressure chamber 8. Then the injection pump proceeds to the next supply process or operation.

In situations requiring no advancement in the injection timing, it is enough to control the injected amount only by the solenoid valve 3 and this is preferable from the point of view of power consumption. It is a matter of course that whether advancement in the injection timing is needed or not is commanded of determined by a signal from the control unit.

Figure 9:
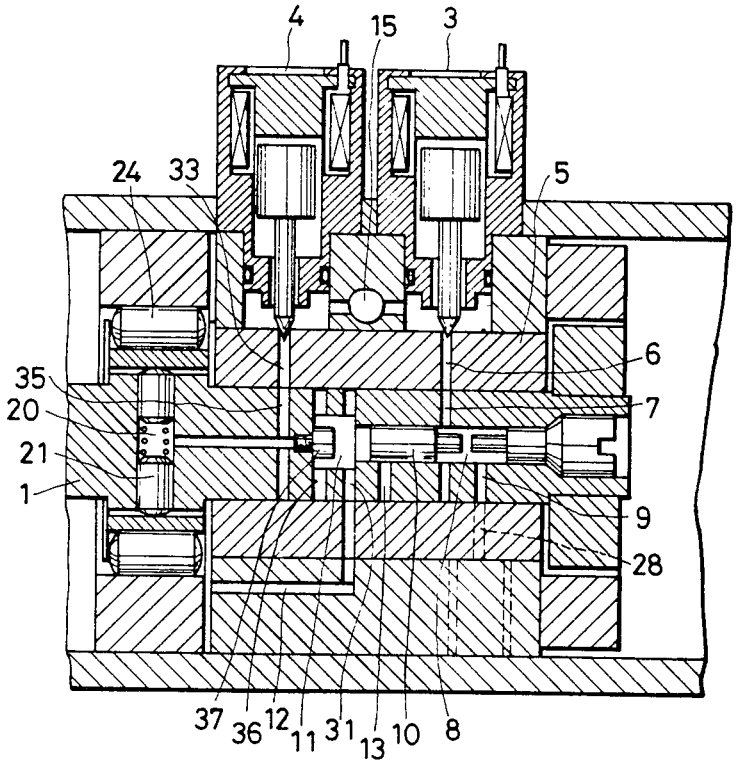
FIG. 9 is a cross-sectional view of a portion of another embodiment of a fuel pump constructed in accordance with the present invention.
Figure 10:
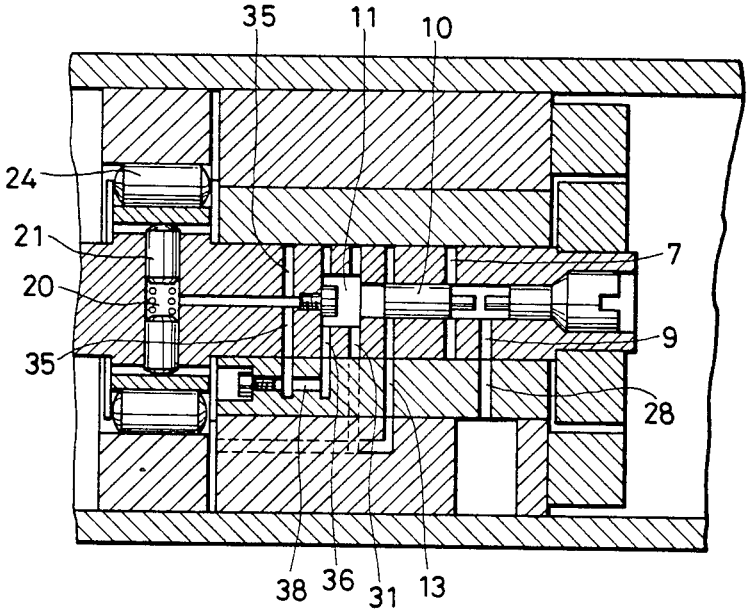
FIG. 10 is a cross-sectional view of another portion of the fuel pump of FIG. 9.

In the embodiment of FIGS. 9 and 10, the fuel pump includes a rotor 1, driven through a shaft (not shown) by an engine (not shown) in a predetermined timed relationship therewith, with a solenoid 3' being provided for measuring the fuel amount concerned with the injected amount and a solenoid 4' being provided for measuring the fuel amount concerned with or relating to the injection timing, with the fuel being supplied from a feed pump (not shown) through a supply passage 15'. The solenoid valves 3', 4' serve to supply fuel to a first high pressure chamber 8 for determining the injected amount and a fourth high pressure chamber 20 for determining the injection timing, respectively. When signals from a control unit having predetermined pulse widths are supplied to the solenoid valves 3', 4', the valves 3', 4' measure the fuel amounts in accordance with the respective pulse widths. The fuel thus measured by the solenoid 3' is supplied to the first high pressure chamber 8 through a fixed supply passage 6' formed in a sleeve 5 and one of a plurality of rotary supply ports 7 formed in the rotor 1, with the supply ports corresponding in number to that of the cylinders of the engine. The supply of fuel to the first high pressure chamber 8 causes a shuttle 10' to be moved to the left, so that the left-side part of the shuttle 10' disconnects a second high pressure chamber 11' from the first spill passage 13 formed in the rotor 1'. Since fuel in the second high pressure chamber 11' is increased in an amount corresponding to a distance along which the shuttle 10' has moved to the left, that is, the amount of fuel supplied to the first high pressure chamber 8, the excessive fuel is discharged to the lower pressure side through a rotary connection passage 31 formed in the rotor 1 at a discharge passage 12' formed in the sleeve 5'. As a result, the fuel measured by the solenoid valve 3' can be supplied in full amount to the first high pressure chamber 8. In this state, a single high pressure port 9 formed in the rotor 1' is disconnected from any of the plurality of outlet ports 28 formed in the sleeve 5', which ports 28 correspond in number to the number of cylinders of the engine, while a fixed connection passage 38 (FIG. 10) formed in the sleeve 5' is disconnected from any rotary connection ports 36 open to the second high pressure chamber 11, which ports 36 correspond in number to the number of cylinders of the engine. In this manner, fuel in an amount equivalent to the injected amount is supplied to the first high pressure chamber 8.

On the other hand, the fuel measured by the solenoid valve 4' is supplied to the fourth high pressure chamber 20 through a fixed supply passage 33 formed in the sleeve 5' and one of the rotary supply ports 35 formed in the rotor 1', which ports 35 correspond in number to the number of cylinders of the engine, simultaneously with a fuel supply to the first high pressure chamber 8. In this state, since the fourth high pressure chamber 20 is disconnected from the second high pressure chamber 11' by a stop bolt, the fuel supplied to the fourth high pressure chamber 20 will not influence the second high pressure chamber 11' and, consequently, the first high pressure chamber 8. Furthermore, the fuel supplied to the fourth high pressure chamber 20 serves to expand the roller 24 outwardly through the plunger 21 and the roller shoe 23.

In the embodiment of FIGS. 9 and 10, the shuttle 10' has the right end face subjected to the supply pressure and the left end face confronting the internal lower pressure side through the second high pressure chamber 11'. Stated differently, there is no cause for interference with the supply pressure, and the fuel supplied to the first high pressure chamber 8 is effected independently regardless of the fourth high pressure chamber 20 for determining the injection timing by virtue of the presence of the stop bolt 37.

As shown most clearly in FIG. 10, during the process of compression and injection of the fuel, with a continued rotation of the rotor 1', the rotary supply ports 7, 35 and the rotary connection passage 31 formed in the rotor 1' are closed, while the high pressure port 9 and the rotary connection passage 36, formed in the rotor 1', starts to communicate with one of the outlet ports 28 and the fixed connection passage 38 formed in the sleeve 5', respectively. Thus, the high pressure chambers enter a compressed state and, as the rotor 1' further continues to rotate, the roller 24 contacts the cam 26 disposed at the outer circumference of the roller 24 at a predetermined position. Simultaneously with the contact between the roller 24 and the cam 26, the plunger 21 is pushed inwardly through the roller shoe 23 to pressurize the fuel in the fourth high pressure chamber 20. The fuel thus pressurized serves to compress the fuel in the second high pressure chamber 11' through the rotary supply port 35 opened to the fourth high pressure chamber 20, the fixed connection passage 38 formed in the sleeve 5', and the rotary connection passage 36 opened to the second high pressure chamber 11'. Moreover, the same pressurized fuel pushes the shuttle 10' to move to the right and hence pressuirzes the fuel in the first high pressure chamber 8. When the pressure in the chamber 8 exceeds a predetermined value, the highly pressurized fuel is injected into a combustion chamber of the engine through a delivery valve, a high pressure tube, and an injection valve (not shown).

In the above described state, as the injection from the first high pressure chamber 8 proceeds, the left end of the shuttle 10' is positioned to communicate the first spill passage 13 with the second high pressure chamber 11' and the fourth high pressure chamber 20, so that the pressurized fuel in the second high pressure chamber 11' and the fuel in the fourth high pressure chamber 20, used for controlling the injection timing, are both discharged to the lower pressure side through the fixed discharge passage 12'. Thus, the pressure in the fourth and second high pressure chambers 20, 11' is lowered and the fuel injection is accordingly completed. The pressure in the fourth high pressure chamber 20 still continues to be lowered until the fuel in the same amount as that previously supplied to the fourth high pressure chamber 20 will be fully discharged therefrom. With this, the supply, compression, injection, and discharge process for one cylinder are all completed and, subsequently, these processes will be repeated in due order so as to perform the required function of the fuel injection pump.

In this connection, the passage means 35, 36, 38, adapted to communicate the fourth high pressure chamber 20 with the second high pressure chamber 11' in the compression process, are effective for all of the cylinders of the internal combustion engine. In the above described operation or process, at the completion of the injection, the shuttle 10' is returned back to the original position where the fuel supply from a solenoid valve 3' has started. Therefore, the supplied amount is equal to the injected amount and the injected amount is determined by the fuel amount calculated by the solenoid valve 3', namely, from a pulse width from the control unit applied to the solenoid valve 3'. On the other hand, since fuel is a non-compressive fluid, the injection timing is determined by the time the fuel starts to be compressed and reaches a predetermined pressure, that is, the time when the fourth high pressure chamber 20 begins to have a high pressure therein. This high pressure is generated upon a contact of the roller 24 with the cam 26, and the contact position is determined by the expanded position of the roller 24 and hence the amount of fuel supplied to the fourth high pressure chamber 20 from the solenoid valve 4'. The amount of fuel is, in turn, determined by a width of a pulse from the control unit applied to the solenoid valve 4'.

It is a matter of course that the supply of fuel to the first high pressure chamber 8, for determining the injected amount in the fuel supply process, will never influence the fourth high pressure chamber 20 for determining the injection timing, and that the injection timing is uniquely determined by the fuel amount measured by the solenoid valve 4'.

While we have shown and described several embodiments in accordance with the present invention, it is understood that the same is not limited thereto but is susceptible to numerous changes and modifications as known to one having ordinary skill in the art and we therefore do not wish to be limited to the details shown and described herein, but intend to cover all such modifications as are encompassed by the scope of the appended claims.

We claim:

1. A fuel injection pump comprising:

rotary shaft means adapted to be rotated within a sleeve means in a predetermined timed relationship with respect to a rotation of an internal combustion engine;

a first high pressure chamber means axially formed inside said rotor shaft for determining an injected amount of fuel;

shuttle means disposed in said first high pressure chamber means for dividing the same into an injection fuel chamber means and a pressurization chamber means, said shuttle means being freely movable in said first high pressure chamber means;

plunger means for pressurizing fuel in said second high pressure chamber means in a predetermined timed relationship with respect to the rotation of the internal combustion engine;

first fuel supply passage means formed in the sleeve means for supplying injection fuel to said injection fuel chamber means;

discharge passage means formed in said sleeve means for discharging fuel in said pressurization chamber means to a lower pressure side when fuel is supplied to said injection fuel chamber means;

a second high pressure chamber means for determining an injection timing of fuel, said second high pressure chamber means being fuild-tightly isolated from said pressurization chamber means when fuel is supplied to said injection fuel chamber means;

second fuel supply passage means formed in said sleeve means for supplying fuel for determining the injection timing to said second high pressure chamber means when fuel is supplied to said injection chamber means;

connection passage means formed in said sleeve means for communicating said pressurization chamber means with said second high pressure chamber means when fuel in said second high pressure chamber means is pressurized by said plunger means; and fuel outlet passage means formed in said sleeve means for introducing fuel in said injection fuel chamber to a fuel injection valve means when fuel in said second high pressure chamber means is pressurized.

2. A fuel injection pump according to claim 1, further comprising electromagnetically operated flow rate control valve means disposed in intermediate portions of said first and second fuel supply passage means.

3. A fuel injection pump according to claim 1, further comprising a second discharge passage means formed in said sleeve means for discharging fuel in said pressurization chamber means when said shuttle means is moved by a predetermined distance in a predetermined direction so as to supply fuel in said injection fuel chamber means toward the fuel injection valve means.

4. A fuel injection pump comprising:

rotor shaft means adapted to be rotated within a sleeve means in a predetermined timed relationship with respect to a rotation of an internal combustion engine;

first high pressure chamber means axially formed inside said rotor shaft means;

second high pressure chamber means axially formed in said rotor shaft means;

third high pressure chamber means fluid tightly isolated from said second high pressure chamber means;

fourth high pressure chamber means fluid-tightly isolated from said second high pressure chamber means;

first shuttle means disposed between said first and second high pressure chamber means so as to be freely movable between said first and second high pressure chamber means;

second shuttle means disposed between said third and fourth high pressure chamber means so as to be fully movable between said third and fourth high pressure chamber means;

plunger means for pressurizing fuel in said fourth high pressure chamber means in a predetermined timed relationship with respect to a rotation of the internal combustion engine;

first fuel supply passage means formed in said sleeve means for supplying injection fuel to said first high pressure chamber means;

discharge passage means formed in said sleeve means for discharging fuel in said second high pressure chamber means when fuel is supplied to said first high pressure chamber means;

second fuel supply passage means formed in said sleeve means for supplying fuel for determining an injection timing to said third high pressure chamber means when fuel is supplied to said first high pressure chamber means;

connection passage means formed in said sleeve means for communicating said third high pressure chamber means with said second high pressure chamber means when fuel in said fourth high pressure chamber means is pressurized by said pressurizing plunger means; and fuel outlet passage means formed in said sleeve means for introducing fuel in said first high pressure chamber means to a fuel injection valve means when fuel in said fourth high pressure chamber means is pressurized.

5. A fuel injection pump according to claim 4, further comprising stopper means formed in said fourth high pressure chamber means for restricting a movement of said second shuttle means such that the second shuttle means moves by a predetermined distance when fuel is supplied to said third high pressure chamber means.

6. A fuel injection pump according to claim 4, further comprising a third fuel passage means in communication with said fourth high pressure chamber means for enabling fuel for determining an injection timing different from fuel supplied to said third high pressure chamber means to be supplied to said fourth high pressure chamber means.

7. A fuel injection pump according to claim 6, wherein said third fuel supply passage means includes electromagnetic measuring valve means.

* * * * *